US006910225B2

(12) United States Patent
Kovalenko

(10) Patent No.: US 6,910,225 B2
(45) Date of Patent: Jun. 28, 2005

(54) HAT AND METHOD FOR MAKING SAME

(76) Inventor: Vladimir Ivanovich Kovalenko, Apt. 137, 163/8 B. Bogatkovast, Novosibirsk 630017 (RU)

( * ) Notice: Subject to any disclaimer, the term of this patent is extended or adjusted under 35 U.S.C. 154(b) by 0 days.

(21) Appl. No.: 10/165,169

(22) Filed: Jun. 4, 2002

(65) Prior Publication Data

US 2002/0178486 A1 Dec. 5, 2002

(30) Foreign Application Priority Data

Jun. 4, 2001 (RU) ..... 2001114926

(51) Int. Cl.[7] ..... A42B 1/00
(52) U.S. Cl. ..... 2/200.3; 2/12; 2/171.1
(58) Field of Search ..... 2/671, 200.3, 209.11

(56) References Cited

U.S. PATENT DOCUMENTS 1,247,415 A * 11/1917 Lattimore ..... 2/195.7
1,631,210 A * 6/1927 Johnson ..... 2/12
2,390,064 A * 12/1945 Gardner ..... 2/209.3
2,594,906 A * 4/1952 Gardner ..... 2/171.01
2,728,084 A * 12/1955 Long ..... 2/209.3
2,988,743 A * 6/1961 Wagenfeld ..... 2/12
3,041,628 A * 7/1962 Fish et al. ..... 2/209.7
3,271,778 A * 9/1966 Ferguson ..... 2/12
4,747,164 A 5/1988 Foulke
5,010,590 A * 4/1991 Haber et al. ..... 2/12
5,054,123 A * 10/1991 Helms ..... 2/12
5,428,842 A 7/1995 Wise
D391,387 S 3/1998 Pogrebitsky et al.
D422,399 S 4/2000 Flugger
6,092,239 A 7/2000 Pogrebitsky et al.

* cited by examiner

*Primary Examiner*—Katherine Moran
(74) *Attorney, Agent, or Firm*—Ipsolon LLP

(57) ABSTRACT

An economical to manufacture and easy to assemble billed hat constructed from a sheet of material having a base portion with a left and right headband portion and a central cap portion extending therefrom is disclosed. The distal ends of the left and right headband portions include an adjustable fastener to detachably secure these portions together to form an adjustable headband. The central cap portion includes at least one fastener to detachably and adjustably secure the cap portion to the headband, thereby defining an adjustable cap of the hat. In preferred embodiments, the base portion has a bill and the hat forms a baseball hat, and the hat is reversible such that a wearer may select one of two different surface indicia to display thereon.

20 Claims, 4 Drawing Sheets

HAT AND METHOD FOR MAKING SAME

FIELD OF THE INVENTION

The present invention relates to hats and a method for making them. More particularly, it relates to making an adjustable hat that is easy and economical to make, assemble, and display surface indicia thereon, and that is preferably constructed from a monolithic, substantially planar, semi-rigid material.

BACKGROUND OF THE INVENTION

Billed hats commonly known as "baseball hats" and "baseball caps" (collectively referred to as "baseball hats" herein) are very popular. The typical baseball hat includes a cap portion sized to rest on a wearer's head and a billed portion extending therefrom, usually at the wearer's forehead such that the billed portion shields the wearer's eyes from the sun.

The exposed surface of the typical baseball hat usually includes surface indicia, such as a sports team's or business' name or logo. A particularly visible, and therefore desirable, location to display such surface indicia is on a front panel of the cap portion adjacent to the billed portion. Accordingly, baseball hats and the like bearing appropriate surface indicia are often used for promotional and advertising purposes.

The typical baseball hat includes a plurality of materials joined together. For example, the cap portion may include a plurality of mesh fabric panels sewn together around a flexible headband. The billed portion is typically planar cardboard or the like covered with a fabric material and joined to the cap portion with known means and methods. Surface indicia is applied at desirable locations, usually by embroidering or the like.

These materials and methods of construction necessarily increase the costs of each hat. In most cases, these costs do not justify the promotional and advertising benefits associated with a business widely distributing complementary hats bearing appropriate surface indicia. For example, a small restaurant owner would not likely give away and widely distribute these types of baseball hats bearing the name of the restaurant to potential patrons or the like. Similarly, despite the protection from the sun associated with wearing a baseball hat at an outdoor sporting event, and the high likelihood of fans wearing such a hat at the event if they had remembered to bring one from home, a vendor or advertiser is not likely to give each fan such a hat. The hats themselves are simply too expensive to justify their use as promotional items.

Attempts have been made to construct billed hats using economical materials such as cardboard and paper. For example, in Russian Pat. No. 19,716 to Aliferenko, a separate, central strip of paper extends between the paper bill of the hat and the paper headband to define a cap area. However, like with traditional cloth hats, considerable manufacturing efforts must be made to construct the various components of these types of paper hats and then assemble them together. These efforts necessarily increase the production costs of each hat. Moreover, the final assembled paper hat is not adjustable around the headband or in the volume of the cap portion. Also, the central strip forming the cap portion is not vividly outlined, offers only a limited surface area for displaying surface indicia thereon, and offers limited structural support, thereby limiting the rigidity of the assembled hat. Accordingly, wearer comfort, ease of use, and the promotional benefits of the hat are compromised. Moreover, these types of hats are not reversible by their wearers.

More recently, attempts have been made to reduce the production costs of hats by making them from a single sheet of cardboard or the like. However, these attempts to reduce the production costs have also compromised the quality and fit of the hat. For example, U.S. Pat. No. 5,010,590 to Haber et al. discloses a visor having a display panel adjacent to a bill with adjustable straps extending from the bill to form a headband. To wear the visor, the wearer must detach the hat from the rectangular sheet of paper-type material, and join the straps together to form the headband. Since the headband is the only means for securing the visor to its wearer, it must fit snuggly around the wearer's head. In practice, the snug fit is uncomfortable for the wearer over prolonged use, and it places significant strain on the straps leading to their premature wear. Moreover, there is no cap portion to protect the wearer's head from the sun and provide additional space for surface indicia.

In addition, known baseball hats and the like that are constructed from a single sheet of material have several limitations. For example, U.S. Pat. No. 6,092,239 to Pogrebitsky et al. and U.S. Pat. No. 5,428,842 to Wise disclose baseball hats having left and right straps extending from a billed portion. The cap portion is defined by five elongate strips of material extending from the billed portion between the left and right straps. The elongate strips are joined at a point near their opposite ends to define a cap portion, and the left and right strips are joined to each other and the end of a central elongate strip to define each hat's headband.

These types of hats require numerous die-cuts in the planar material to form the elongate strips, and they also require at least one alignment hole or the like to be cut into each elongate strip, thereby increasing the assembly time and related costs of each hat. Moreover, because of spacing requirements between the various components forming each hat, a significant portion of the planar material is wasted when forming the hat. In addition, the volume of the cap portion in this type of hat is not adjustable, and considerable time, effort, and some cases even special fasteners are required to fully assemble each hat. In practice, a patron receiving these types of hats in unassembled form, such as at a sporting event, may find it too difficult or too confusing to assemble. Accordingly, he may simply throw such a hat away rather than use it, thereby destroying any promotional value offered by the hat.

Moreover, the numerous elongate strips that form the cap portion of these types of hats make it difficult to place an easily viewable continuous surface indicia, such as a large logo or the like, on the cap portion of the hat. For example, a large logo would have to be printed onto each elongate strip in segments such that when the cap is assembled, they would align to form the logo. It can be difficult for a wearer to consistently assemble and align such strips in such a manner as to prevent distracting the viewer's view of the overall logo. Moreover, such structures to not lend themselves to being reversible, thereby precluding a wearer from selecting between two different patterns of surface indicia to display on the hat. It can be difficult for a wearer to consistently assemble and align such strips in such a manner as to prevent distracting the viewer's view of the overall logo.

SUMMARY OF THE INVENTION

Accordingly, despite the improvements offered by known baseball hat designs, there remains a need for an economical and easy to manufacture billed hat that has an adjustable cap volume, and that is easy and economical to manufacture and assemble, preferably from a monolithic, substantially planar, semi-rigid material such as cardboard or the like, and that allows a large amount of surface indicia to be easily applied and displayed. In addition to other benefits that will become apparent in the following disclosure, the present invention fulfills these needs.

The present invention is a hat, which is preferably a baseball hat, constructed from a sheet of material having a base portion, which preferably forms a bill, a left and right headband portion, and a central cap portion extending therefrom. The distal ends of the left and right headband portions include an adjustable fastener to detachably secure these portions together to form an adjustable headband.

The central cap portion preferably includes left and right ends toward the distal ends of the cap portion. These ends each include an adjustable fastener for detachably and adjustably securing the left end to the left headband portion and the right end to the right headband portion. The cap of the hat is defined by the cap portion between the left and right headband portions, and a wearer may adjust the size of the cap by moving the adjustable fasteners securing the ends to the headband portions.

In a preferred embodiment, the hat is die-cut from a sheet of material, such as cardboard, and the various portions of the hat are defined using three cuts: one cut between the left and center portion, one cut between the right and center portions, and one perimeter cut defining the overall outline of the hat. More preferably, the hat also includes three fold lines: one each between the billed portion and each of the left, right and center portions.

The left and right portions have an outer surface that is wide enough to display surface indicia thereon, defining left and right surface indicia panels, respectively. Moreover, the center cap portion has an outer surface that includes a forward facing surface indicia panel adjacent to the billed portion and a rearward facing surface indicia panel toward the distal end of the center cap portion. The left, right, forward-facing, and rearward-facing surface indicia panels are sized and shaped to be aesthetically interesting and pleasing, but also to allow easy viewing of the surface indicia placed thereon. Surface indicia may also be placed on the upper and lower sides of the billed portion.

In a preferred embodiment, the hat is reversible such that a wearer may select between two different surface indicia to display by electing which of two sides of the semi-rigid material to display as the outer surface of the hat.

DETAILED DESCRIPTION OF THE PREFERRED EMBODIMENT

Figure 1:
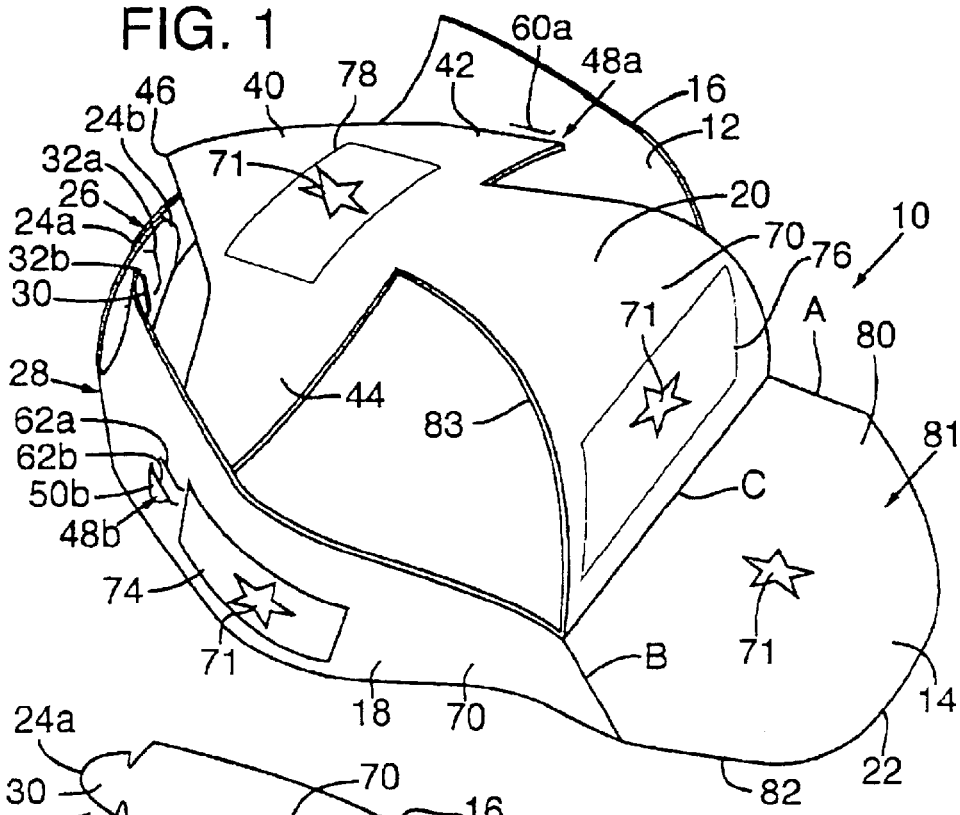
FIG. 1 is an isometric, front view of a fully assembled baseball hat manufactured in accordance with a preferred embodiment of the present invention showing one possible side of the substantially planar material forming an outer surface of the hat.

An adjustable hat 10 constructed from a sheet of material 12 having an exterior 81 surface, an interior surface 83, a base portion, which is preferably a billed portion 14 with a left and right headband portion 16, 18, respectively, and a central cap portion 20 extending therefrom is disclosed in FIGS. 1–8.

A. Preferred Hats

Figure 2:
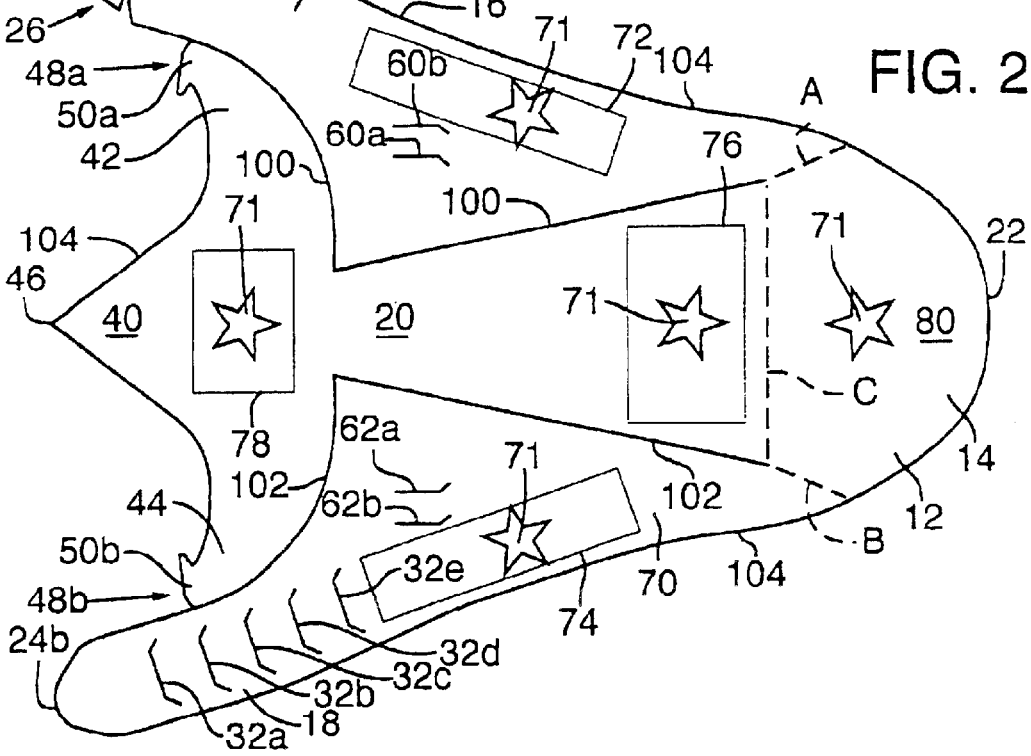
FIG. 2 is a top plan view of a substantially planar material cut in accordance with a preferred embodiment of the present invention, that when assembled in accordance with a preferred embodiment of the present invention, forms the baseball hat of FIG. 1.

As best shown in FIGS. 1 and 2, the billed portion 14, preferably has an arcuate outer edge 22 opposite the headband portions 16, 18 and central cap portion 20. The left and right headband portions 16, 18 are secured at one end to the billed portion 14, preferably at fold lines A and B, respectively. The opposite ends 24*a*, 24*b* of the headband portions 16, 18 include an adjustable fastener 26 to detachably secure these portions 16, 18 together to form an adjustable headband 28. For example, one of the left and right headband portions 16, 18 (left headband portion 16 is shown in FIGS. 1 and 2) preferably includes a notched tab 30, while the other of the left and right headband portions (right headband portion 18 is shown in FIGS. 1 and 2) includes a plurality of space-apart slots 32*a*–*e* for matingly engaging the notched tab 30, thereby detachably securing the headband portions 16, 18 together to form an adjustable headband 28.

The central cap portion 20 is secured on one end to the billed portion 14, preferably at fold line C, and is preferably shaped to be symmetrical about a longitudinal centerline of the cap portion. More preferably, the cap portion forms a generally t-shaped portion 40 having left and right ends 42, 44, respectively, toward the distal end 46 of the central cap portion 20. The left and right ends 42, 44 each include an adjustable fastener 48*a*, 48*b*, respectively, for detachably and adjustably securing the left end 42 to the left headband portion 16 and the right end 44 to the right headband portion 18. For example, the left and right ends 42, 44 each preferably include a notched tab 50*a*, 50*b*, respectively, while the respective headband portions 16, 18 each include a plurality of space-apart slots 60*a*, 60*b* and 62*a*, 62*b*, respectively, for matingly engaging their respective notched tabs 50*a*, 50*b*, thereby detachably securing the central cap portion 20 to the adjustable headband 28.

Preferably, the left and right headband portions 16, 18 have a first surface 70 that is wide enough to display surface indicia 71 thereon, defining left and right surface indicia panels 72, 74, respectively. Moreover, the center cap portion 20 has a first surface 70 that includes a forward-facing surface indicia panel 76 adjacent to the billed portion 14 and a rearward-facing surface indicia panel 78 toward the distal end 46 of the center cap portion 20. The first surface 70 forms the exterior surface 81 of the hat thereby displaying surface indicia 71. The left, right, forward-facing and rearward-facing surface indicia panels 72, 74, 76, 78 are sized and shaped to be aesthetically interesting and pleasing, but also to allow easy viewing of the surface indicia 71 placed thereon. Surface indicia may also be placed on the upper side 80 and lower side 82 of the billed portion 14.

Figure 3:
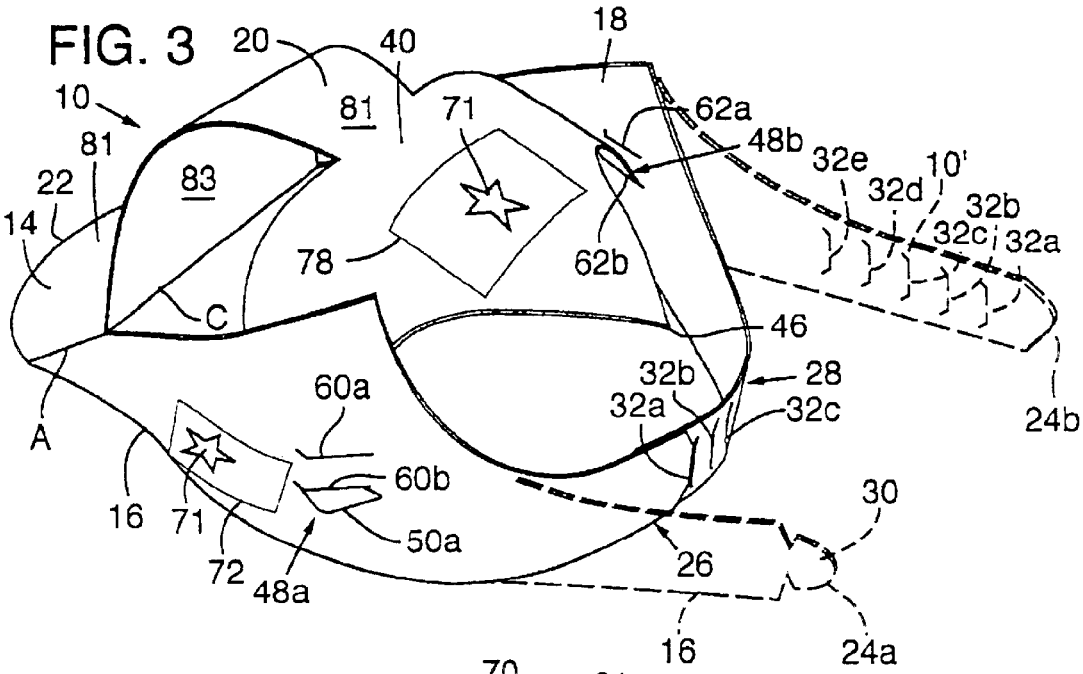
FIG. 3 is an isometric, rear side view of the hat of FIG. 1 with the left and right headband portions also shown unattached in broken lines.
Figure 4:
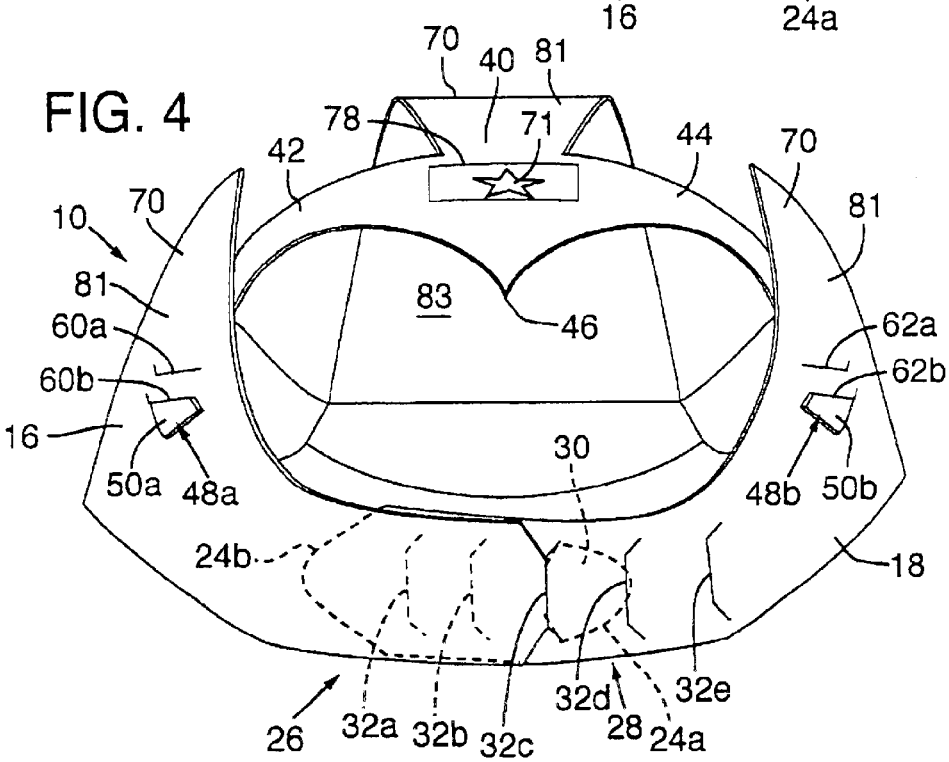
FIG. 4 is a rear plane view of the hat of FIG. 1.

To assemble the hat 10 as shown in FIG. 1 from its substantially planar configuration shown in FIG. 2, the assembler folds the central cap portion 20 upward along fold line C. The assembler then folds the left and right headband portions 16, 18 sideways along fold lines A, and B, respectively. As best shown in FIG. 3, the assembler then inserts the notched tabs 50*a*, 50*b* of the left and right ends 42, 44 of the central cap portion 20 into the respective mating slots (slots 60*b* and 62*b* are shown in FIG. 3) on the left and right headband portions 16, 18. The assembler then joins the left and right headband portions 16, 18 together by engaging notched tab 30 into one of the respective mating slots (slot 32*a* is shown in FIG. 3).

It can be appreciated that the size, or volume, of the cap of the hat, which is defined by the area under the central cap portion 20, can be easily adjusted by selecting the desired mating slots 60*a*, 60*b*, 62*a*, 62*b* into which the notched tabs 50*a*, 50*b* of the left and right ends 42, 44 are inserted. Moreover, the diameter of the central cap portion 20 can be easily adjusted to a desired size by selecting the appropriate slot 32*a–e* into which the notched tab 30 of the headband portion is inserted.

Figure 7:
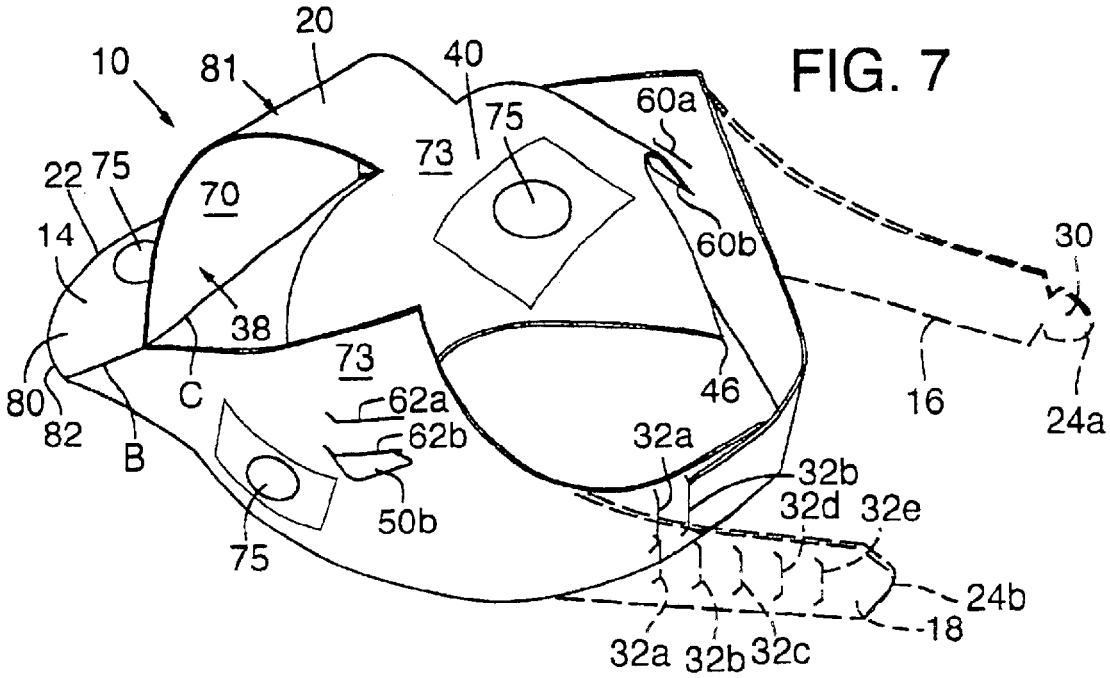
FIG. 7 is an isometric, rear side view of the hat of FIG. 5 with the left and right headband portions also shown unattached in broken lines.
Figure 8:
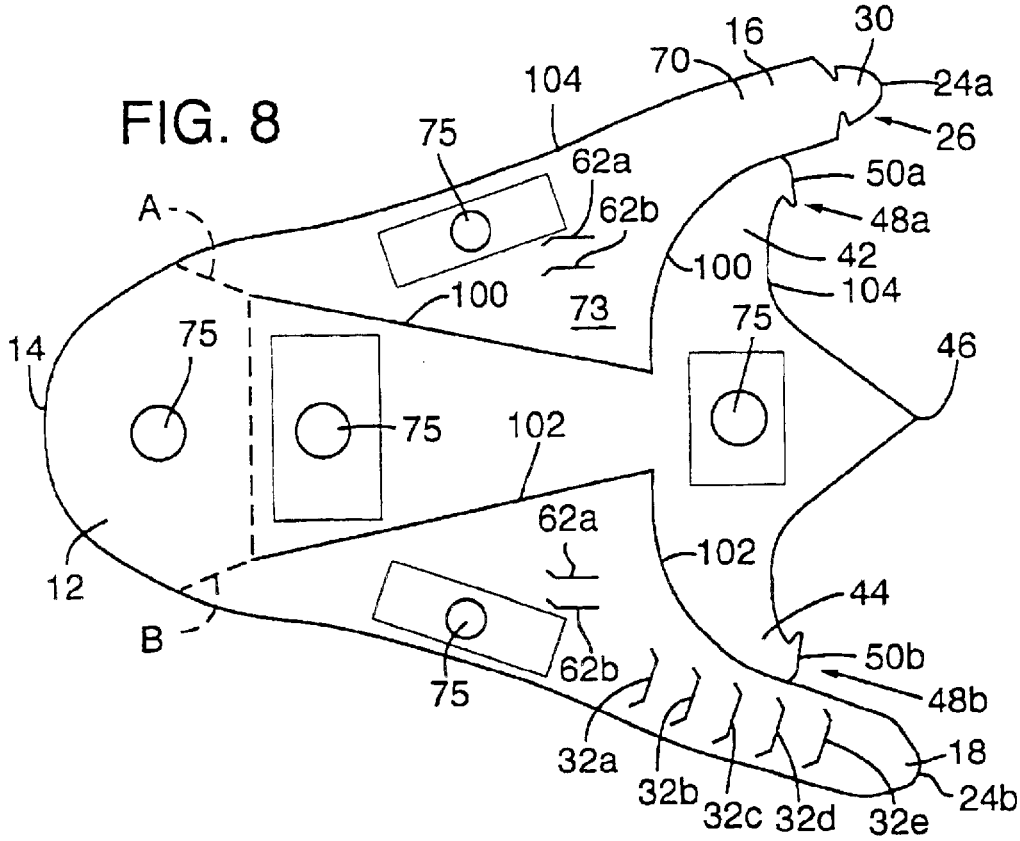
FIG. 8 is an isometric, rear side view of the fully assembled baseball hat manufactured in accordance with a preferred embodiment of the present invention showing a second possible side of the substantially planar material forming the outer surface of the hat.

In addition, as best shown in FIGS. 7 & 8, the second surface 73 can also include surface indicia 75 thereon. It can be appreciated that the adjustable fasteners 48*a*, 49*b* operably engage their respective components, such as the notched tabs 30, 50*a*, 50*b*, operably engage their respective mating slots 32*a–e*, 60*a–b*, 62*a–b*, respectively, such that the second surface 73 can also form the exterior surface 81 of the hat as shown in FIG. 7. Accordingly, it can be appreciated that the hat can be assembled such that either the first surface 70 (FIG. 1) or second surface 73 (FIG. 7) is displayed. Accordingly, in such an embodiment, the assembler has a choice when assembling the hat as to which surface indicia 71 or 75 to display, thereby making the hat reversible.

Such assembly is so quick and easy, that when presented with the hat 10 in the unassembled form of FIG. 2, most assemblers can figure out how to assemble and adjust it for comfort with no specific instructions. Accordingly, the hat 10 may be economically distributed in unassembled form as a promotional item with a high likelihood that recipients will assemble and wear it. In such case, the labor costs associated with assembling each hat are avoided.

Figure 5:
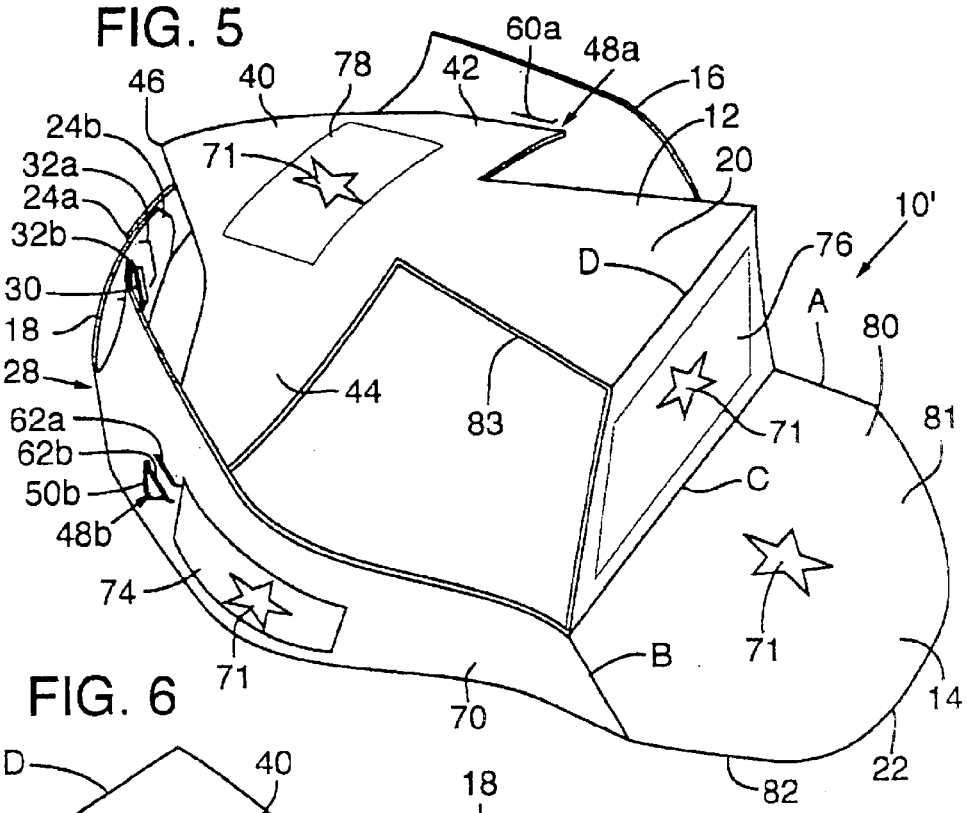
FIG. 5 is an isometric, front view of an alternative preferred baseball hat in accordance with a preferred embodiment of the present invention.
Figure 6:
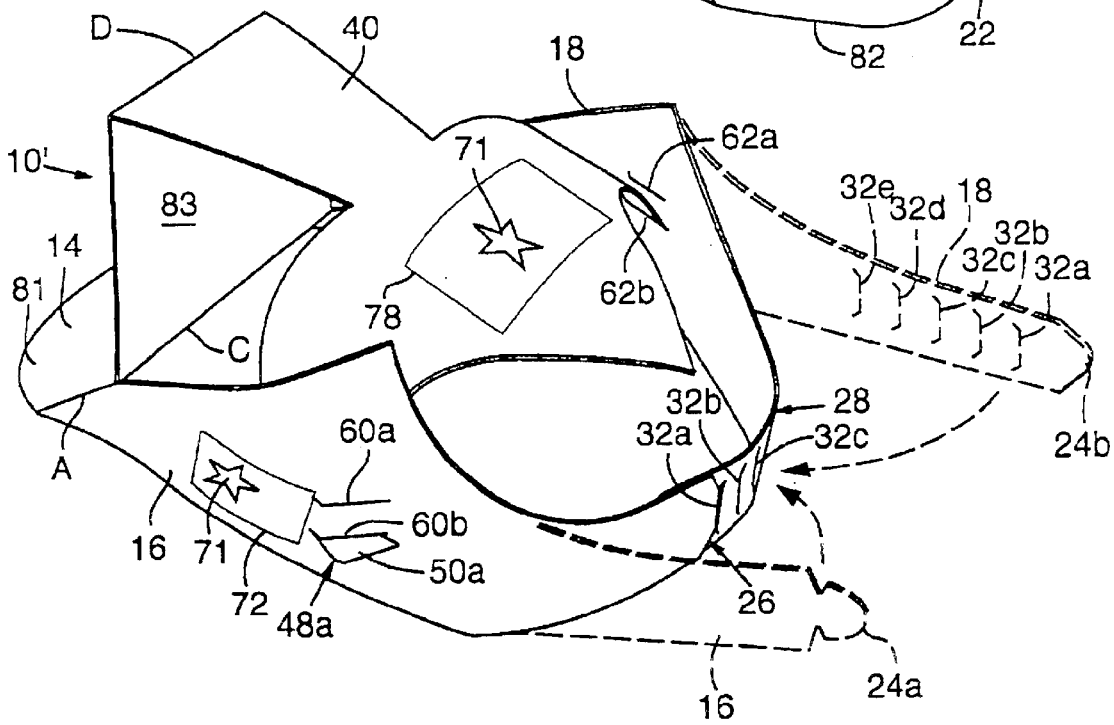
FIG. 6 is a bottom plan view of the substantially planar material of FIG. 2.

An alternative preferred embodiment of the hat 10' is disclosed in FIGS. 5 and 6. This embodiment has substantially the same basic elements, construction and assembly of the previously described embodiment. Accordingly, in order to avoid undue repetition, unless specifically identified otherwise below, reference numerals refer to like numbered elements having a like orientation and configuration as those elements identified in the discussion of the first preferred embodiment.

In this embodiment, the central cap portion 20 includes fold line D, spaced apart from and substantially parallel to fold line C to define a substantially planar forward facing surface indicia panel 76 on the fully assembled hat 10' as shown in FIG. 5. This substantially planar forward facing surface indicia panel 76 allows the surface indicia 71 on that panel 76 to be more easily viewed when the hat 10' is worn.

B. Preferred Manufacturing Method

The hat 10, 10' according to the present invention is preferably manufactured according to the following process:

First, desired surface indicia 71, 75 is placed on a sheet of semi-rigid material 12, such as cardboard, plastic, paper, tissue, or the like. Preferably, the sheet of material 12 is a monolithic structure. More preferably, the surface indicia 71 is sized, shaped and oriented to occupy the areas of the sheet of material that will ultimately become the left, right, forward facing, and rearward facing surface indicia panels 72, 74, 76, 78 and the upper and lower sides 80, 82 of the billed portion 14. Of course, if desired, one or more of these areas can not have surface indicia thereon.

The sheet of material 12 is then cut, preferably using conventional die cutting techniques, using three cuts: one cut between the left and center portion, shown as solid line 100 in FIG. 2, one cut between the right and center portions, shown as solid line 102 in FIG. 2, and one perimeter cut defining the overall outline of the hat, and shown as solid line 104 in FIG. 2. Preferably, folds A, B, C, and D (FIG. 5, alternative preferred embodiment only) and slots 32*a–e*, 60*a–b*, and 62*a–b* are also added as shown in FIG. 2. Preferably, an industrial manufacturing blanking die is used to make all such cuts in one pass.

It can be appreciated that the four essential portions 14, 16, 18, 20 of the present hat 10, 10' can be formed using three cuts 100, 102, 104, and that no material is wasted between the various portions. The resulting hats 10, 10' are easy and economical to manufacture, and are particularly well suited for distribution as promotional or advertising items.

In view of the wide variety of embodiments to which the principles of the invention can be applied, it should be apparent that the detailed embodiments are illustrative only and should not be taken as limiting the scope of the invention. For example, the shape and overall perimeter of the cuts 100, 102, 104 may be modified for to achieve a hat having a desired shape when assembled. Moreover, the number of ends 42, 44 extending from the central cap portion 20 can be increased, and the shape, orientation, and number of folds C and D (FIG. 5) can be modified or increased as needed or desired. Rather, the claimed invention includes all such modifications as may come within the scope of the following claims and equivalents thereto.

What is claimed is:

1. A billed hat formed from a planar material, said hat having:

a billed portion;

left and right headband portions extending from the billed portion defining distal ends and including a first fastener to detachably secure the distal ends of the left and right headband portions together thereby defining a headband;

a central, substantially T-shaped, cap portion extending from said billed portion and having at least a left end and a right end extending therefrom, said left and right ends including second and third fasteners for detachably securing to the headband, thereby defining a cap having a defined volume.

2. The billed hat of claim 1, wherein said first fastener is adjustable such that the length of the headband is adjustable.

3. The billed hat of claim 1, wherein said first fastener is a first tab at a distal end of one of the left and right headband portions, and the other of the left and right headband portions includes a plurality of spaced-apart slots toward the distal end of said other of the left and right headband portions such that the left and right headband portions may be detachably secured together by the intersection of the tab with one of the plurality of slots.

4. The billed hat of claim 3, wherein the size of the headband may be adjusted by selecting a desired slot into which the tab is inserted.

5. The billed hat of claim 1, wherein said second and third fasteners are adjustable such that the volume of the hat is adjustable.

6. A billed hat formed from a planar material, said hat having:

a billed portion;

left and right headband portions extending from the billed portion defining distal ends and including a first fastener to detachably secure the distal ends of the left and right headband portions together thereby defining a headband;

a central, substantially T-shaped, cap portion extending from said billed portion and having at least a left end and a right end extending therefrom, said left and right ends including second and third fasteners for detachably securing to the headband, thereby defining a cap having a defined volume;

said second fastener is a second tab at the end of the left end, and said third fastener is a third tab at the end of the right end; and, said left and right headband portions include a plurality of spaced apart slots for detachably securing the second tab to the left headband portion and the third tab to the right headband portion.

7. The billed hat of claim 6, wherein the volume of the cap may be adjusted by selecting desired slots into which the second and third tabs are inserted.

8. A billed hat formed from a planar material, said hat having;

a billed portion;

left and right headband portions extending from the billed portion defining distal ends and including a first fastener to detachably secure the distal ends of the left and right headband portions together thereby defining a headband;

a central cap portion extending from said billed portion and having at least a left end and a right end extending therefrom, said left and right ends including second and third fasteners for detachably securing to the headband, thereby defining a cap having a defined volume; and, said central cap portion includes forward-facing and rearward-facing surface indicia panels.

9. The billed hat of claim 8, wherein said forward-facing surface indicia panel is substantially planar.

10. The billed hat of claim 1, wherein said left and right headband portions include surface indicia panels.

11. A billed hat formed from a monolithic, planar material, said hat having:

a billed portion;

left and right headband portions extending from the billed portion defining distal ends and including a first fastener to detachably secure the distal ends of the left and right headband portions together thereby defining a headband;

a central, axis symmetrical, cap portion extending from said billed portion and having at least a left end and a right end extending therefrom, said left and right ends including second and third fasteners for detachably securing to the headband, thereby defining a cap having a defined volume; and said planar material has a first surface and a second surface, and said left and right headband portions and said central cap portions may be operably secured such that an assembler may select one of either the first surface and the second surface to form an exterior surface of the hat, thereby making the hat reversible.

12. The billed hat of claim 11, wherein said first surface and said second surface have different surface indicia thereon.

13. A method for making a billed hat from a sheet of material, said hat having a base portion, a left headband portion, a right headband portion and a central, axis-symmetrical, substantially T-shaped, cap portion, said method comprising the steps of:

providing a monolithic sheet of material;

placing three cuts in the material: one perimeter cut defining the overall outline of the hat, and two elongate cuts, wherein each elongate cut intersects the perimeter cut at one end, and terminates at a defined location along the sheet of material to define the base portion, left and right headband portions, and central cap portion of the hat such that the base portion is adjacent to one end of each of the left and right headband portions and the central cap portion, and the central cap portion is between the left and right headband portions, fastening the central cap portion to the headband portions to define a cap of the hat.

14. The method of claim 13, further including the step of applying surface indicia to a face of the monolithic sheet of material.

15. The method of claim 13, further including the step of applying three fold lines to the sheet of material, one fold line between the left headband portion and the billed portion, one fold line between the right headband portion and the billed portion, and one fold line between the central cap portion and the billed portion.

16. A method for making a billed hat from a sheet of material, said hat having a base portion, a left headband portion, a right headband portion and a central, axis-symmetricals cap portion, said method comprising the steps of:

providing a monolithic sheet of material;

placing three cuts in the material: one perimeter cut defining the overall outline of the hat, and two elongate cuts, wherein each elongate cut intersects the perimeter cut at one end, and terminates at a defined location along the sheet of material to define the base portion, left and right headband portions, and central cap portion of the hat such that the base portion is adjacent to one end of each of the left and right headband portions and the central cap portion, and the central cap portion is between the left and right headband portions;

cutting tabs on the ends of the central cap portion to serve as fasteners;

placing a plurality of spaced-apart slots into the left and right headband portion for detachably securing the central cap portion to the headband portions; and, fastening the central cap portion to the headband portions to define a cap of the hat.

17. The method of claim 16, wherein the step of placing three cuts in the sheet of material further includes cutting a tab into one of the left and right headband portion; and further including the step of placing a plurality of spaced-apart slots into the other of the left and right headband portion for detachably securing the headband portions together to form the headband of the hat.

18. A reversible hat formed from a planar material having a first side and an opposite second side, said hat having:

a base portion having an outer surface;

left and right headband portions extending from the base portion defining distal ends and including a first fastener to detachably secure the distal ends of the left and right headband portions together thereby defining a headband, said first fastener operable with either the first side and the second side forming the outer surface of said base portion;

a central, substantially T-shaped, cap portion extending from said base portion and including a second fastener for detachably securing to the headband, thereby defining a cap having a defined volume, said second fastener operable with either the first side and the second side forming the outer surface of the base portion;

such that an assembler may select either the first side or second side to display as the outer surface.

19. The reversible hat of claim 18, wherein said first side and said second side include surface indicia thereon.

20. The reversible hat of claim 19, wherein the surface indicia on said first side differs from the surface indicia on said second side.

* * * * *